US008573392B2

(12) United States Patent
Bennett et al.

(10) Patent No.: US 8,573,392 B2
(45) Date of Patent: Nov. 5, 2013

(54) MODIFIED ATMOSPHERE PACKAGING FOR ULTRASOUND TRANSDUCER CARTRIDGE

(75) Inventors: Frederick Jay Bennett, Bellevue, WA (US); Jeffrey Robert Crunkilton, Everett, WA (US); Gregory T. Wing, Carnation, WA (US); Elmer Yee, Bothell, WA (US)

(73) Assignee: Liposonix, Inc., Hayward, CA (US)

( * ) Notice: Subject to any disclaimer, the term of this patent is extended or adjusted under 35 U.S.C. 154(b) by 0 days.

(21) Appl. No.: 13/233,974

(22) Filed: Sep. 15, 2011

(65) Prior Publication Data

US 2012/0067750 A1 Mar. 22, 2012

Related U.S. Application Data

(60) Provisional application No. 61/385,507, filed on Sep. 22, 2010.

(51) Int. Cl.
*B65D 85/28* (2006.01)

(52) U.S. Cl.
USPC ..... 206/213.1; 600/437; 600/436; 165/139

(58) Field of Classification Search
USPC ..... 600/437, 446; 206/5.1, 213.1
See application file for complete search history.

(56) References Cited

U.S. PATENT DOCUMENTS 3,191,674 A * 6/1965 Richardson ..... 165/158
3,669,003 A * 6/1972 King ..... 99/331
3,984,302 A * 10/1976 Freedman et al. ..... 204/274
4,029,208 A * 6/1977 Fickler et al. ..... 206/454
4,429,577 A * 2/1984 Sorenson et al. ..... 73/644
5,037,459 A * 8/1991 Spruill et al. ..... 96/118
5,375,698 A * 12/1994 Ewart et al. ..... 206/5.1
5,429,833 A * 7/1995 Wyslotsky ..... 426/122
5,690,215 A 11/1997 Kimball et al.
5,698,250 A * 12/1997 DelDuca et al. ..... 426/124
5,820,549 A * 10/1998 Marian, Jr. ..... 600/437
5,879,314 A * 3/1999 Peterson et al. ..... 601/2
6,230,883 B1 5/2001 Colombo
6,325,769 B1 12/2001 Klopotek
6,624,539 B1 * 9/2003 Hansen et al. ..... 310/26
7,923,630 B2 * 4/2011 Richardson ..... 174/17 LF
7,946,986 B2 5/2011 Bockenstedt et al.

(Continued)

FOREIGN PATENT DOCUMENTS

DE 19956921 A1 7/2001
DE 102006027304 A1 12/2007
WO 02069723 A2 9/2002

OTHER PUBLICATIONS

European Patent Office, Search Report and Written Opinion issued in related International Application No. PCT/US2011/052831 dated Feb. 23, 2012.

*Primary Examiner* — Andrew Perreault
*Assistant Examiner* — James M Van Buskirk
(74) *Attorney, Agent, or Firm* — Wood, Herron & Evans LLP

(57) ABSTRACT

A modified atmosphere package for extending the shelf life of a replaceable transducer cartridge having a sealed volume and containing a fluid. The fluid may be fluid or a gas. If a fluid, such as water, then the modified atmosphere package may be configured to prevent the loss of fluid or the entry of gas into the transducer cartridge.

13 Claims, 6 Drawing Sheets

(56) References Cited

U.S. PATENT DOCUMENTS

| | | | | |
|---|---|---|---|---|
| 8,282,554 | B2 | 10/2012 | Makin et al. | |
| 2007/0140921 | A1 | 6/2007 | Mitchell | |
| 2008/0243035 | A1* | 10/2008 | Crunkilton | 601/2 |
| 2009/0216121 | A1* | 8/2009 | Lacoste | 600/439 |
| 2011/0072970 | A1 | 3/2011 | Slobodzian et al. | |
| 2011/0077514 | A1 | 3/2011 | Ulric et al. | |
| 2011/0077555 | A1 | 3/2011 | Wing et al. | |
| 2011/0077556 | A1 | 3/2011 | Bockenstedt et al. | |
| 2011/0077557 | A1 | 3/2011 | Wing et al. | |

* cited by examiner

MODIFIED ATMOSPHERE PACKAGING FOR ULTRASOUND TRANSDUCER CARTRIDGE

CROSS-REFERENCE TO RELATED APPLICATION

This application claims the benefit of U.S. Provisional Application No. 61/385,507, filed Sep. 22, 2010, the full disclosure of which is incorporated herein by reference.

BACKGROUND

Modified Atmosphere Packaging (MAP) is a practice of modifying the composition of the internal atmosphere of a package, generally in the field of food or drug storage, in order to improve shelf life. The modification process often tries to lower the amount of oxygen in the package, and sometimes replacing it with an inert gas. Reduction of the oxygen content for food and drug storage improves shelf life by slowing the growth of aerobic organisms. It can also slow the oxidation of certain reactions. Carbon dioxide ($CO_2$) can be used to inhibit the growth of bacteria. The packaging typically can slow the movement of water vapor in or out of the package that may cause the products to degrade.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

MAP can be used to improve the shelf life on non-food and non-drug products where the normal environment may cause early degradation of the product. Modified atmosphere packaging technology can be adapted to extend the shelf life of medical devices.

In an embodiment, there can be a medical device in the form of a replaceable transducer cartridge (cartridge). The cartridge defines a container with a sealed volume having a liquid contained therein. The container may have places where the liquid may escape the confines of the container, or where atmosphere from outside the container may enter the container. Loss of liquid or entry of gas can be tolerated to some degree. The medical device may not operate as desired if liquid or gas seepage reaches a level that can inhibit the proper operation of the medical device. The cartridge may be stored and/or shipped in a modified atmosphere package as an extra layer placed around the cartridge for sealing out the outside environment. This can reduce the gas, liquid or liquid vapor seepage to a level where the shelf life of the medical device may be extended.

In an embodiment there can be an apparatus for storing a replaceable transducer cartridge. The apparatus comprises a package with a base defining a volume, and a cover for sealing the volume. A replaceable transducer cartridge may be received in the volume and sealed within the volume using the cover. The volume may contain a modified atmosphere.

In some embodiments, the volume may also contain an insert to help maintain the modified atmosphere.

In some embodiments, the volume may be filled with a gas.

In some embodiments, the package may be resealed.

Some embodiments may also be sealed within another package such as a second layer modified atmosphere package, a shipping package or a bag.

For a fuller understanding of the nature and advantages of the present invention, reference should be made to the ensuing detailed description and accompanying drawings.

DETAILED DESCRIPTION

Figure 1:
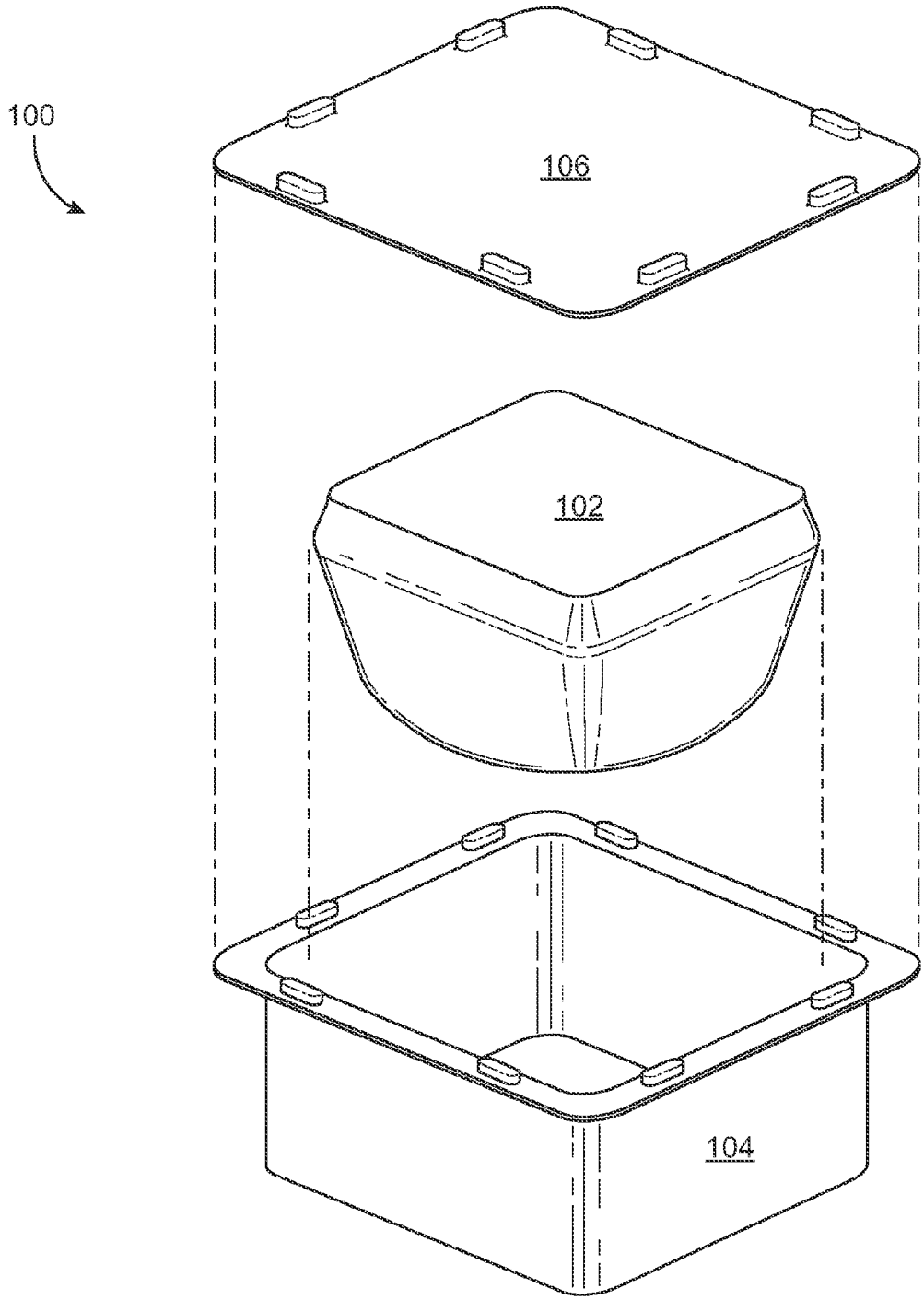
FIG. 1 illustrates an exemplary exploded assembly view of a storage system for shelf life extension

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Described herein are various modified atmosphere packages for use with a replaceable transducer cartridge (cartridge). Cartridges that may be used with the packaging described herein are further described in co-pending U.S. patent application Ser. No. 12/794,611 entitled "Cartridge for Use with an Ultrasound Therapy Device", filed Jun. 4, 2010, and herein incorporated in its entirety by reference. The cartridge can contain an ultrasound transducer in a liquid environment. The cartridge is generally sealed to prevent liquid or vapor from the liquid from escaping the cartridge. The seal also helps to prevent gas from entering the cartridge. The seal may also prevent the contamination of the liquid within the cartridge. Sealing or being sealed refers to using those techniques known in the art for enclosing a cartridge or package to prevent as much as practical the loss or degradation of the internal environment. Sealing generally does not provide an absolute barrier against loss or degradation of the internal environment, but does allow the internal content to be preserved. Economic factors often determine how well a product may be sealed, and balancing cost benefit and usability of sealing techniques generally drive how the cartridge or package may be sealed.

The sealing of the cartridge may suffer from inefficiencies or limitations of the cartridge material or sealing technology. These inefficiencies may allow liquid in vapor form to escape the cartridge, or gas to enter the cartridge. In some environments, liquid may escape the cartridge at volumes approaching 1 milliliter (ml) per month. Loss of liquid of about 2 ml may render the cartridge unusable.

Liquid may be depleted more rapidly if the cartridge is stored in a hot and dry environment, promoting the drying out of vulnerable components of the cartridge. These vulnerable areas may include interconnection points, seal joints, and polymer (or rubber) surfaces. Gas seepage into the cartridge may diffuse through the same vulnerable components. A modified atmosphere and packaging can help extend the shelf life by maintaining the integrity of vulnerable components, or by reducing liquid/gas diffusion rates.

In an embodiment, there may be a package having a base and a cover. The base and cover may define a volume in combination, or one component (base or cover) may define a volume while the other component covers the volume and can be used to seal the volume. The volume can be sufficient to receive one or more replaceable transducer cartridge(s), or other medical device component(s). The package may be shaped to accommodate multiple cartridges in individual cells, and may allow each cell to be opened independent of other cells. The volume when sealed can contain a modified atmosphere. Sealing may be via any method as well known in the related art, such as use of thermo-sealing, interference fit, adhesive agent, et cetera.

In another embodiment, the volume may be liquid filled or partially liquid filled. In this embodiment, there may be exposed electrical contacts on the cartridge. These electrical contacts may be protected from the liquid by using one or more of the following on or around the electrical contacts: an electrical grease, a wax or polymer film, a polymer or metal shield.

In various aspects of the invention, the volume defined by the package and containing the cartridge may be gas filled. In some embodiments the gas may be an inert gas. In some embodiments the gas may be any one of, or combination of: nitrogen, argon or helium. In some embodiments the gas may be one or more of the noble gases.

In some embodiments, the volume defined by the package and containing the cartridge may contain an insert. In some embodiments the insert may be a pouch or other container containing a chemically reactive material that helps preserve the modified atmosphere within the volume of the package. The insert may be an oxygen scrubber. In some embodiments the insert may be a desiccant pack.

In some embodiments, the insert may be a moisture retaining element, such as a product made of one or more of cloth, paper, foam, sponge, wick or other material able to hold liquid and at the same time allow the liquid to evaporate into the immediate internal atmosphere. The moisture retaining element may have sufficient capacity to maintain a high relative humidity level within the sealed volume defined by the base and cover, with the cartridge(s). The humidity level may be about 60% or higher. In other embodiments the humidity level may be about 80% or higher, and in still other embodiments, the humidity level may be about 95% or higher. In other embodiments the environment may be super-saturated with humidity above 100%.

In an exemplary embodiment, the cartridge may be sealed within a close fitting package. A volume of space may exist between the cartridge and the interior wall of the package. The volume of space may be filled with nitrogen, argon and/or helium, all having low solubility in water. A moisture retaining element may also be inserted into the volume and saturated with water to provide a high humidity environment in the volume of space. The volume of space may be pressurized to a positive gauge pressure (higher pressure inside the package than the local atmospheric pressure). The package base and cover may be made from high barrier polymers, such as liquid crystal polymers (LCP), polyvinylidene chloride (PvDC), polychlorotrifluoroethylene (PCTFE), cyclic olefin copolymer (COC), or combinations thereof. If combinations are used, the combinations may be laminate layers, or from compounds of two or more of the materials, or both. Other materials may be used if treated to provide high barrier characteristics, such as metallization with titanium or zirconium. Material selection can be guided by the content of the modified atmosphere to maximize the retention of the modified atmosphere within the package.

FIG. 1 illustrates a non-limiting embodiment of the invention. A modified atmosphere package 100 is shown having a base 104 defining a volume, and a cover 106 for sealing the volume defined by the base 104. A cartridge 102 may be received within the volume defined by the package 100. The volume may be defined by either the base 104 or the cover 106, or the base and the cover may define a volume in combination.

The packaging may be optimized for use with a cartridge containing an ultrasound transducer stored in a liquid environment. In such aspects of the invention, the modified atmosphere package described herein can preserve the interior environment of the cartridge, and thus extending the shelf life of the cartridge. The shelf life of the cartridge may be measured by the loss of liquid from inside the cartridge, or the seepage of gas into the cartridge, or the contamination of the liquid inside the cartridge.

The loss of the liquid from the inside of the cartridge may cause the depth of the focused ultrasound to be outside of specification of the device and make the cartridge unusable. Loss of liquid from the cartridge may render the cartridge unusable. The rate of loss of fluid from the cartridge may be about 1 milliliter (ml) per month. If the cartridge loses 2 ml of liquid, the usability of the cartridge may be seriously compromised.

In one aspect, the invention addresses this by substantially reducing fluid loss. The use of a modified atmosphere package can reduce the liquid loss from the cartridge. In one non-limiting embodiment, the fluid loss of the cartridge may be reduced to about 2 ml every six months. In another embodiment the loss can be reduced to about 1 ml per six months. In still another embodiment, the fluid loss can be reduced to about 1 ml every 12 months. Thus, if the acceptable liquid loss can be about 2 ml over the life of the product, the use of the modified atmosphere package can extend the shelf life to about 24 months.

In another aspect, the shelf life of the cartridge may be determined by measuring the gas content within the cartridge. This can be either dissolved gases or gas bubbles in the liquid environment of the cartridge. Gas bubbles are generally undesirable. During operation of the ultrasound transducer in the cartridge, dissolved gases may come out of solution and form bubbles. This can be an undesirable event.

Dissolved gases tend to have equal part relation to other gases. That is, the measurement of one gas can often predict the level of other dissolved gases. Dissolved oxygen can be a good indicator of the amount of dissolved gas in the liquid environment of the cartridge. In some embodiments, the dissolved oxygen content may be less than about 13 parts per million (PPM). In some embodiments the dissolved oxygen content may be less than about 11 PPM. In other embodiments there may be less than about 8 PPM while still other embodiments may have less than about 5 PPM. By preventing seepage of gas into the cartridge, the shelf life of the cartridge may be increased.

Another factor that may be used to measure the shelf life of the cartridge can be the level of contamination in the liquid contained in the cartridge. Contamination may be biological growth, degradation of the materials within the cartridge or degradation of the cartridge itself. The contamination may be measured using a bio growth strip assay to measure bacterial or fungal growth. This may be measured at the factory from stored products in testing. Field units may be measured for particulate matter that interferes with the ultrasound transmission. Particulate matter and gas bubbles can interfere in the proper use of the cartridge as described in previously submitted and commonly assigned U.S. patent application Ser. No. 12/729,447 entitled "Analysis of Real Time Backscatter Data for Fault Signal Generation in a Medical HIFU Device" filed Mar. 23, 2010 and herein incorporated by reference. Testing of the liquid for degradation of the cartridge structure, biocompatibility or contamination testing, can be measured using various testing methods as are well understood by their respective arts.

In some embodiments, the modified atmosphere of the package may be liquid, such as water, degassed water, previously boiled water, or a water based coupling fluid. In some embodiments the liquid may be a low viscosity organic compound (such as mineral oil). The liquid may contain additives, such as fungicide, biocide, salt(s), or other compounds that may extend the shelf life of the cartridge.

Figure 2:
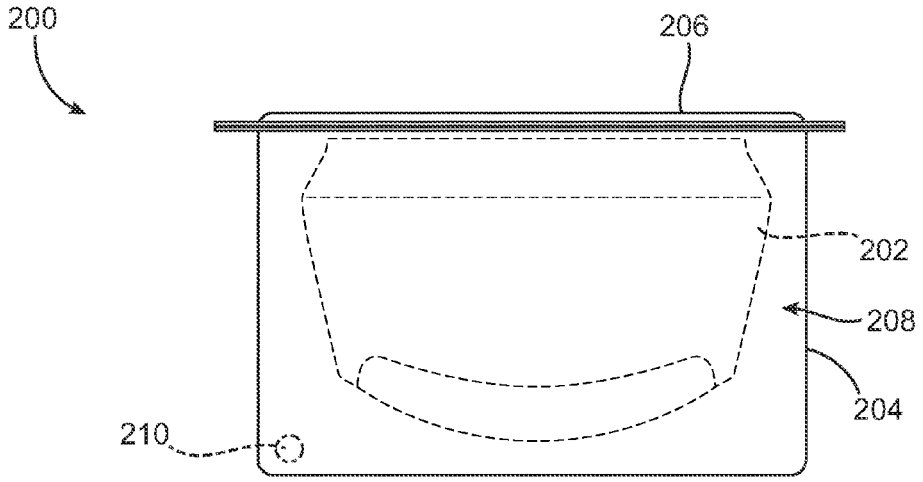
FIG. 2 illustrates a side view of the exemplary shelf life extension package with an outline of a transducer cartridge.

Various alternative embodiments are now shown. In an embodiment shown in FIG. 2, the cartridge 202 can be sealed within the package 200, formed from a base 204 and a cover 206. The volume 208 defined by the package 200 can be largely occupied by the cartridge 202. The volume 208 not occupied by the cartridge 202 may be filled with a modified atmosphere in order to preserve the atmosphere within the cartridge 202 itself. Optional insert 210 may be placed within the volume 208 to help preserve the modified atmosphere within the volume. The volume 208 may contain a gas such as nitrogen, argon or helium, all having low solubility in water. If another liquid is used in the cartridge 202, an appropriate low solubility gas may be used as the modified atmosphere gas to fill the volume 208.

If the liquid inside the cartridge is water, or a water based liquid, the volume 208 between the cartridge and the package base/cover may contain a moisture retaining insert. In this manner water may be added to the insert, and promote a high humidity environment. The use of a high humidity environment in the volume 208 can reduce the loss of liquid or liquid vapor from inside the cartridge.

In some embodiments, the volume 208 may contain more than one insert, such as the insert 210. Various inserts, such as the insert 210, may be useful to preserve the modified environment. As an example, element scrubbers (like an oxygen scrubber) can prevent the buildup of certain undesirable gases. As another example, a moisture retaining element may help preserve the humidity of the modified atmosphere. As still another example, a desiccant pack maybe used to keep the modified environment dry, and may be particularly useful in embodiments where the cartridge may contain a gas, or non-water based liquid.

Alternatively the volume 208 may be liquid filled with more of the same kind of liquid as used inside the cartridge. If the cartridge has exposed electrical contacts, it may be necessary to cover or shield those electrical contacts from the liquid. This can be done by the application of a non-water soluble protective coating, such as electrical grease, wax or plastic film.

In another embodiment, the package base and cover may be coated on the inner surface with a material to help one or more of reduce moisture loss, prevent gas seepage and shield the cartridge from contaminants. The material used to coat the base and cover may be a metallization layer or application of a multi-laminate polymer layer. The polymers in the multi-laminate layer may be any high barrier polymer described herein. The metallization layer may be sputtered titanium or zirconium, or other metals as are well known in the metallization industry. Similarly the use of a multi-laminate polymer-metal-polymer layer may be selected to best preserve the modified atmosphere, and can be selected based on the atmosphere used in the package.

Figure 3:
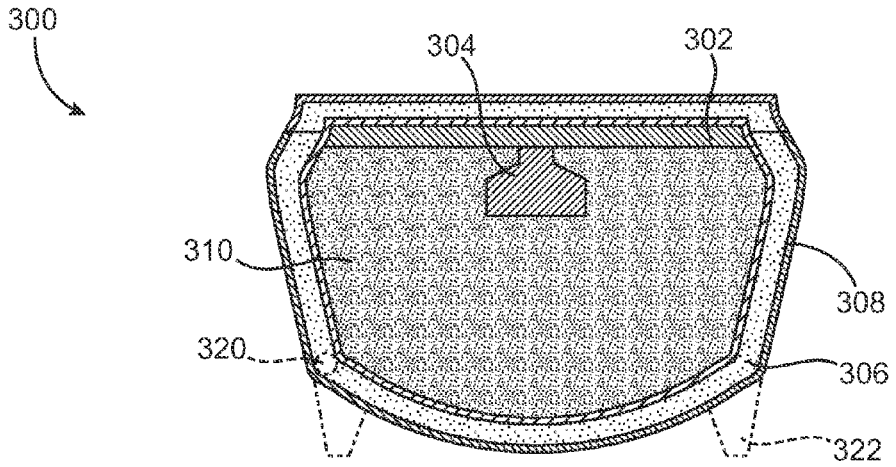
FIG. 3 shows a cross section view of the exemplary system.

Alternatively, the package 300 may be shaped to provide a closer fit to the cartridge 302 (FIG. 3). Here the package 300 is shown in a cross section view with a closer fitting design. The cartridge 302 has an ultrasound transducer 304 and a liquid filled interior 310. The cartridge is contained in a modified atmosphere that fills the volume 306 between the combined base and cover 308 of the package and the cartridge 302. An insert 320 may be provided as above. In addition, optional "feet" 322 may be added to the package exterior to allow the package to sit properly if the package has an irregular shape.

The package may be opened in a destructive manner (such as tearing it apart or cutting it open) or in a non-destructive manner (such as unscrewing a screw top, pulling apart interference fitting halves, or any other manner readily known to those skilled in the art). In the case where the package is opened through a non-destructive method, the package may be re-usable. In one embodiment, a user may open and reseal the package on demand, removing or replacing the cartridge as often as desired. When the cartridge is restored to the package, the resealing of the package may offer additional protection against loss of shelf life of the cartridge. It may be possible for the user to regenerate some or all of the modified environment, such as adding water to a moisture retaining element before resealing the cartridge in the package.

In another embodiment, the package may be reusable by returning the package to the manufacturer for a refill of both a new cartridge and replenishment of the modified atmosphere and/or inserts.

Figure 4:
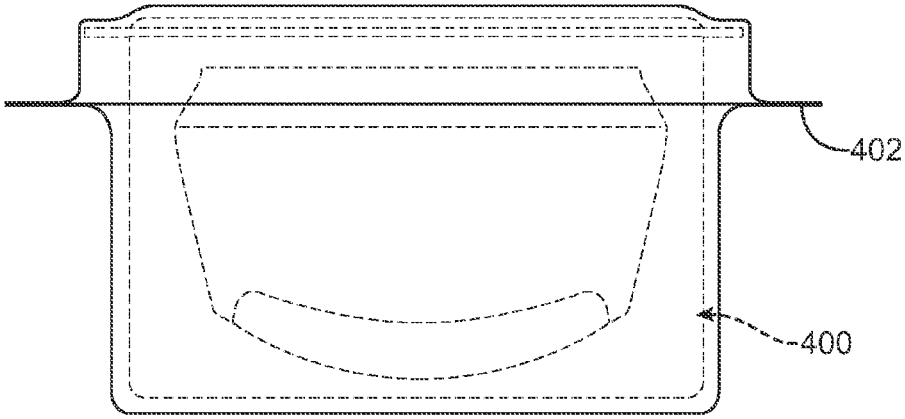
FIG. 4 shows an optional second modified atmosphere package layer.

An optional additional modified atmosphere package may be used as an added layer of protection for the cartridge. As shown in FIG. 4, the additional modified atmosphere 402 package may be similar to the package described above, but with a volume sufficiently large enough to receive the first package 400 (containing the cartridge), or it may be a package akin to an electrostatic discharge (ESD) bag (FIG. 4). The optional package may have a modified atmosphere similar to any described herein.

Figure 5:
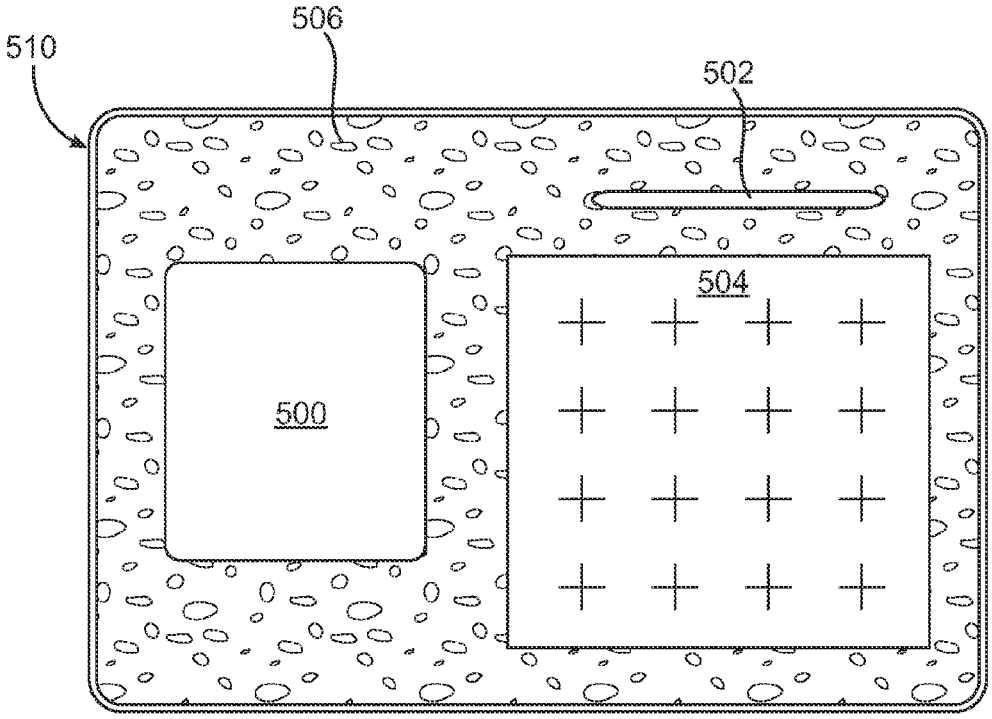
FIG. 5 shows a packaging kit containing a layered modified environment package system.

A shipping kit may be assembled using the packaging system 500 (FIG. 5), with a template 504 for assisting in the use of the medical device along with a pen or marker 502. The ensemble is placed within a packing safe shock absorbing material 506 such as foam and sealed in a shipping container 510 (e.g. a cardboard box).

Multiple kits may be packed together in a bulk container with inserts to help preserve the internal environment of the bulk container. Desiccant packs and oxygen scavengers may be used as an economical and simple method of preserving a gaseous bulk container environments. A fuel cell with a hydrogen reserve may also be used to actively consume oxygen and help protect the bulk environment.

Figure 6:
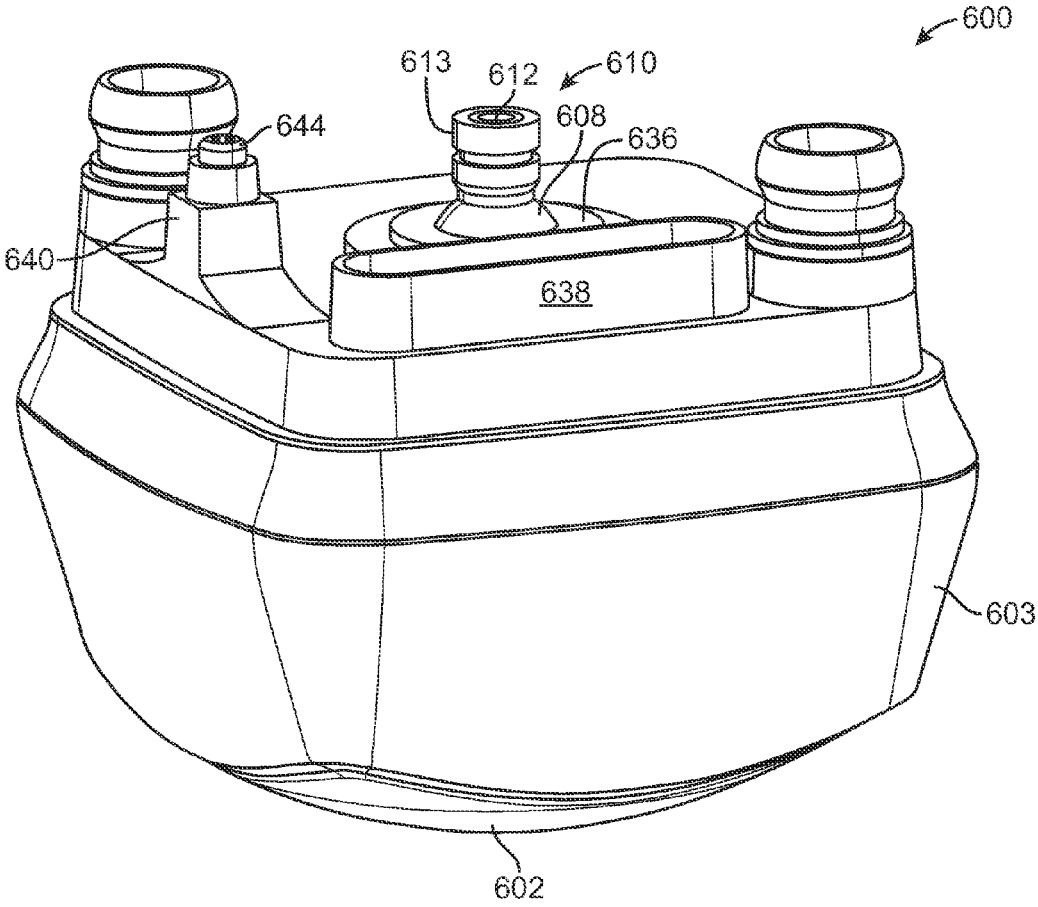
FIG. 6 shows a perspective view of an embodiment of a transducer cartridge that may utilized in accordance with embodiments.
Figure 7:
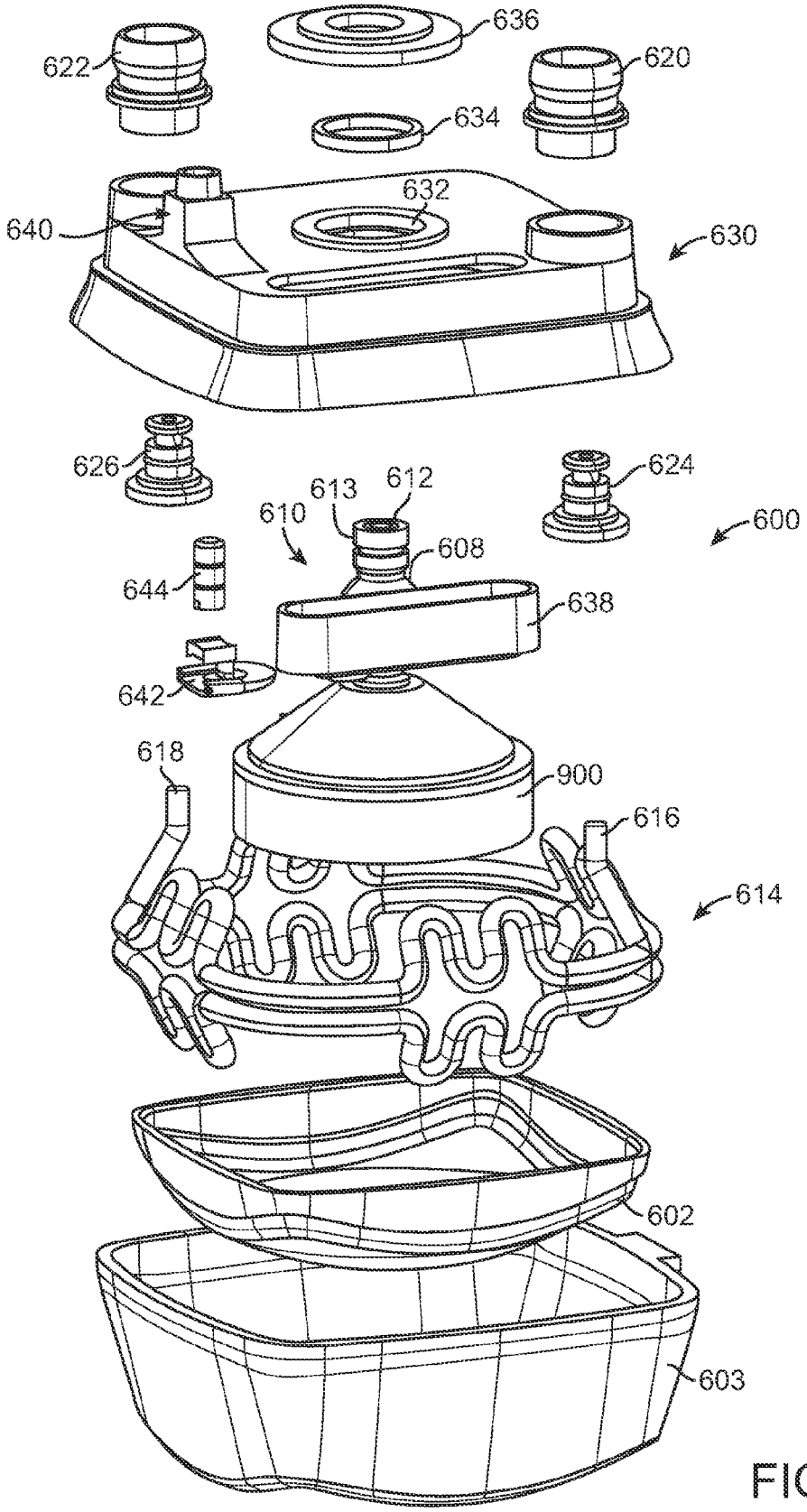
FIG. 7 is an exploded perspective view of the transducer cartridge of FIG. 6.

An embodiment of a transducer cartridge 600 that may be used in a modified packaging container is shown in FIGS. 6 and 7. The transducer cartridge 600 is described in detail in U.S. patent application Ser. No. 12/794,611 entitled "Cartridge for Use with an Ultrasound Therapy Device", filed Jun. 4, 2010, set forth above. Although details of the transducer cartridge may be found in that reference, a description is repeated here for the convenience of the reader.

The transducer cartridge 600 includes a transducer assembly 900 (FIG. 7) mounted therein and having a ball joint 608. The ball joint 608 is part of a pivot mechanism 610, such as is described in U.S. patent application Ser. No. 12/794,611, cited above. An opening 612 is located at the end of a shaft 613 for the transducer assembly 900.

The transducer cartridge 600 includes a heat exchanger 614 that extends along the inside of the side walls 603 for the transducer cartridge 600. The heat exchanger 614 is preferably formed of a highly thermally conductive material, such as copper. In the embodiment shown in the drawings, the heat exchanger 614 includes two sets of tubes that extend in a serpentine path around a perimeter of the transducer cartridge 600, inside the side walls 603, although other configurations of heat exchangers may be used. In an embodiment, the heat exchanger 614 is arranged so that it maximizes space on the outer portions of the transducer cartridge 600, but is outside the range of movement of the transducer assembly 600. In one aspect, a cooling system for the ultrasound therapy head is able to remove as many cooling watts from the cartridge 600 as necessary via the heat exchanger 614 to maintain a desired operational temperature.

The heat exchanger 614 includes an inlet conduit 616 and an outlet conduit 618. The inlet and outlet conduits 616, 618 may be mounted to ball seals 620, 622 and include valve fittings 624, 626. The seals 620, 622 are mounted in a top-plate 630 of the transducer cartridge 600. The top-plate 630 includes a central opening 632 through which the shaft 613 extends. An O-ring 634 is mounted in the opening and seats against the ball joint 608. The shaft 613 and the ball joint form a bearing member that fits in the central opening 632. The O-ring 634 permits the transducer assembly 900 to pivot as described in U.S. patent application Ser. No. 12/364,327, and prevents leaking of fluid out of the transducer cartridge 600 at the opening 632. A pivot top 636 fits over the O-ring 634. The ball joint 608 is captured between the pivot top 636 and the inner rim of the opening 632.

An electrical connector 638 is positioned on one side of the top plate 630. Wires may run from the electrical connector 638 to the transducer assembly 900. In addition, the electrical connector 638 may be configured to receive a wiring harness or other electrical connections that lead from the upper compartment. In an alternate embodiment, the wires for the transducer cartridge 600 may extend along or down the shaft 613, or may be routed in another manner. The electrical connector 638 is preferably a quick disconnect connector and connects to a wiring harness or other connector (not shown) that is attached to the therapy head. When the wiring harness is attached to the connector 638, power, such as for the HIFU transducer drive or for other electronics in the transducer assembly, or communication signals may be supplied to the transducer cartridge 600 via the wiring circuit.

Optionally, an alignment post 640 is positioned on one location of the top plate 630. The alignment post 640 permits an installer to properly align the transducer cartridge 600 with an upper compartment of the therapy head during installation. A bubble trap 642 may be provided for the capture of bubbles formed inside the transducer cartridge 600. In an embodiment, a micro valve 644 is attached to the bubble trap 642 to isolate bubbles away from the acoustic path of the transducer. The micro valve may be mounted in the alignment post 640.

The transducer cartridge 600 can be sealed, with the acoustic window 602, the sides 603, and the top-plate 630 forming an enclosure. A coupling fluid, such as water is captured in the enclosure, and the enclosure is permanently sealed. The heat exchanger 614 extends around the perimeter of this enclosure and provides optimal heat convection because of its serpentine or parallel path configuration, the large amount of surface area provided by extending the heat exchanger 614 around the perimeter, and by utilizing the dual conduit arrangement.

In use of the ultrasonic device, water is circulated through the heat exchanger 614 via the inlet conduit 616 and the outlet conduit 618. This water may be circulated, for example, to a base unit for cooling, or may be attached to a thermoelectric cooler for cooling, or may be routed through a conduit with inefficient heat retention that results in heat loss, as examples.

Figure 8:
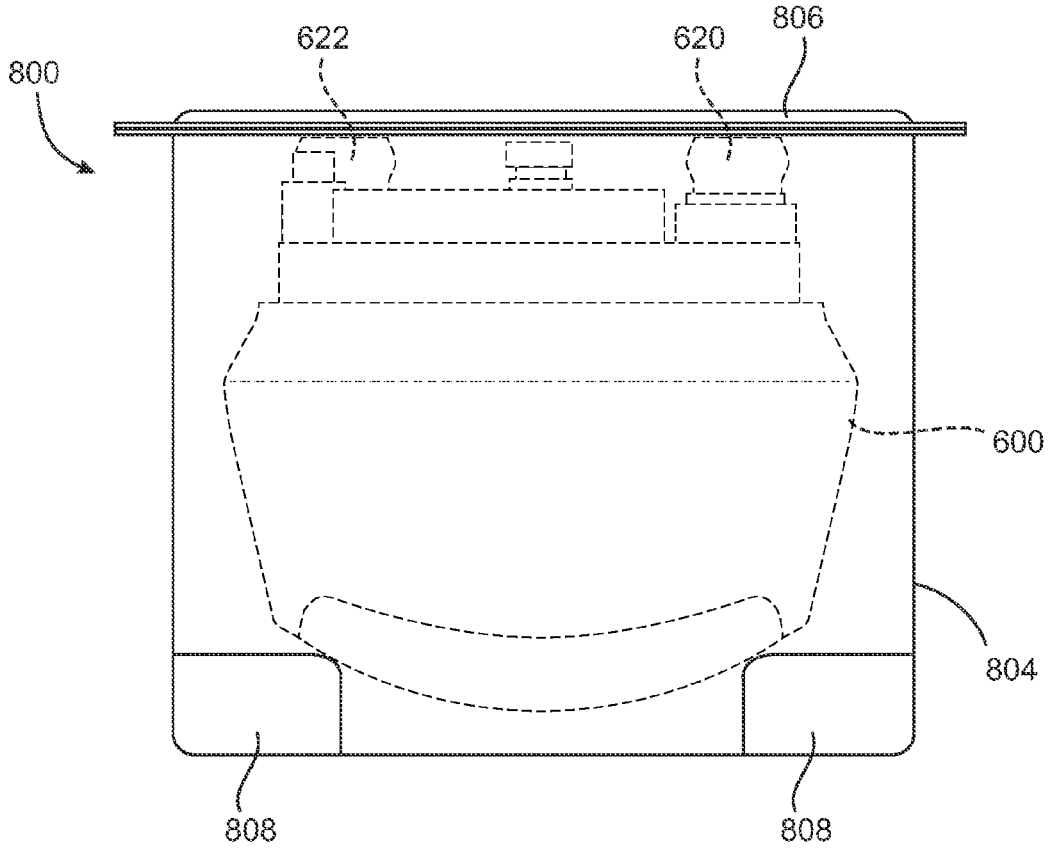
FIG. 8 is a side view of a package for containing the transducer cartridge of FIGS. 6 and 7.

In embodiments, the transducer cartridge 600 is mounted in a sealed package, such as the modified atmosphere package 800 shown in FIG. 8. The transducer cartridge 600 is mounted in a base 804, with the conduits 616, 618 positioned at the top of the package, just below or just in contact with the cover 806. If desired, internal feet, such as the feet 808, may be provided to seat the transducer cartridge 600. There may be four or more or less feet in the base 804, with the feet arranged to contact a bottom of the transducer cartridge 600. The feet 808 and close contact of conduits 616, 618 with the cover 806 may be used to stabilize the cartridge 600 in the package 800.

To promote a high humidity environment in a package containing the transducer cartridge, water, such as distilled water, may be put into the heat exchanger 614 prior to sealing the cover 106. The water in the heat exchanger promotes a high humidity environment in the modified atmosphere package 100, and thus prevents water loss in the transducer cartridge. The use of a high humidity environment in the volume 208 can reduce the loss of liquid or liquid vapor from inside the cartridge.

The amount of water placed in the heat exchanger 614 may be selected based upon the acceptable loss of water of the transducer cartridge 600 during shipping and storage. In embodiments, as described above, this loss may be 2 ml. However, the loss may take into account loss after the transducer cartridge has been installed and before its useful life is expended. Thus, for a transducer cartridge, such as the transducer cartridge, an acceptable loss may be X (e.g., 2 ml), but of that loss, Y may be lost during storage in the modified atmosphere packaging, and Z may be lost after removal from the packaging and during use. Thus, Y+Z should not exceed X. In an embodiment, X is 2 ml, Y is 0.5 ml, and Z is 1.5 ml. By setting Z to this level, it has been found that water or vapor loss of 1.5 ml does not occur until about 18 months, which should be more than sufficient time for the cartridge to be used. Applicants have found that putting a minimum of 0.5 to 1.5 ml of water into the heat exchanger 614 prior to sealing the cover 106, then the loss of water Y while the cartridge is in the package 800 remains at 0.5 ml or less. In embodiments, the heat exchanger 614 has a volume much greater than this amount, such as 3.6 ml, so there is no need to completely fill the heat exchanger with water prior to sealing of the package.

Use of the heat exchanger 614 to store water for modifying the package provides numerous benefits. First, a separate insert does not have to be provided. Second, assuming the package is not turned over, the water provided in the heat exchanger 614 does not spill into the package, and thus loose water in the package is not an issue. Third, if the heat exchanger 614 is formed of copper, that material acts as a natural antimicrobial, and thus bacteria or other contaminants being formed within the package is minimized.

If desired, a bag or other closeable structure, such as a resealable package, may be provided for a consumer to store a transducer after opening of the modified atmosphere package. The resealable package may be, for example, a sealable waterproof bag, such as a bag with a zip closure. This temporary structure may also have a modified atmosphere. As examples of such structures, a consumer may be supplied an insert to which water may be added, or may be provided instructions to partially fill the heat exchanger when temporarily storing the cartridge. Such a temporary closeable structure may further prolong the useful life of a cartridge after opening the modified atmosphere package.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. An apparatus for use with an ultrasound therapy head, the apparatus comprising:

a package having a base defining a volume and a cover configured to be removably attached to said base; and a cartridge received within the first volume, the cartridge including an enclosure configured to be removably coupled with the ultrasound therapy head, a coupling fluid inside the enclosure, an ultrasound transducer inside the enclosure, a heat exchanger external to the enclosure, and water in the heat exchanger, wherein the cover seals the cartridge within the first volume when attached to the base, the water has a volume of 0.5 milliliters to 1.5 milliliters, and the sealed first volume contains a modified atmosphere comprising a humidity level greater than or equal to 60%.

2. The apparatus of claim 1, wherein the base and the cover are configured to be resealed after the cover is detached from the base.

3. The apparatus of claim 1, wherein the apparatus further comprises:

a second package having a base defining a second volume for receiving a sealed package therein, and a second cover for sealing the second volume.

4. The apparatus of claim 3, wherein the second volume is filled with gas.

5. The apparatus of claim 3, wherein the second volume is filled with a liquid.

6. The apparatus of claim 1, further comprising a modified atmosphere bag for receiving said apparatus, the bag being filled with an inert gas and having a positive gauge pressure.

7. The apparatus of claim 1, wherein the heat exchanger comprises copper.

8. The apparatus of claim 1, further comprising:

internal feet for contacting the cartridge and stabilizing the cartridge in the package.

9. The apparatus of claim 1, wherein the humidity of the modified atmosphere originates from the water in the heat exchanger.

10. The apparatus of claim 1, wherein the humidity has a level greater than or equal to 80%.

11. The apparatus of claim 1, wherein the humidity has a level greater than or equal to 95%.

12. The apparatus of claim 1, wherein the humidity has a level greater than or equal to 100%.

13. The apparatus of claim 1 wherein the heat exchanger includes at least one conduit that is partially filled by the water.

* * * * *